US005438821A

United States Patent [19]

Schulte-Werning

[11] Patent Number: 5,438,821

[45] Date of Patent: Aug. 8, 1995

[54] METHOD AND APPLIANCE FOR INFLUENCING THE WAKE OF COMBUSTION CHAMBER INSERTS

[75] Inventor: Burkhard Schulte-Werning, Basel, Switzerland

[73] Assignee: ABB Management AG, Baden, Switzerland

[21] Appl. No.: 208,830

[22] Filed: Mar. 11, 1994

[30] Foreign Application Priority Data

Mar. 22, 1993 [DE] Germany ..... 43 09 131.8

[51] Int. Cl.[6] ..... F23R 3/02

[52] U.S. Cl. ..... 60/39.02; 60/740

[58] Field of Search ..... 60/39.02, 755, 756, 60/757, 759, 760, 39.31, 740

[56] References Cited

U.S. PATENT DOCUMENTS

| | | | |
|---|---|---|---|
| 3,184,918 | 5/1965 | Mulcahey | 60/759 |
| 3,353,351 | 11/1967 | Bill et al. . | |
| 3,600,892 | 8/1971 | Bryce . | |
| 3,656,297 | 4/1972 | Monk | 60/755 |
| 4,622,821 | 11/1986 | Madden | 60/755 |
| 4,653,279 | 3/1987 | Reynolds | 60/755 |
| 4,700,544 | 10/1987 | Fucci | 60/759 |

FOREIGN PATENT DOCUMENTS

| | | |
|---|---|---|
| 2010612 | 2/1971 | France . |
| 1476887 | 9/1969 | Germany . |
| 1476892 | 11/1970 | Germany . |

*Primary Examiner*—Timothy S. Thorpe

*Attorney, Agent, or Firm*—Burns, Doane, Swecker & Mathis

[57] ABSTRACT

In a method and an apparatus for influencing the wake of combustion chamber inserts, a passage (5) for guiding an additional air mass flow (3) is arranged in the inserts (2), which passage is connected to outlet openings (6) which are arranged in the part of the inserts located opposite to the main flow (1). The additional air mass flow (3) is, for example, extracted from the combustion chamber cooling air (4), is guided through the passage (5) and is blown out through the outlet openings (6) before the actual combustion zone in such a way that the recirculating flow region is minimized in the wake of the inserts (2).

8 Claims, 1 Drawing Sheet

METHOD AND APPLIANCE FOR INFLUENCING THE WAKE OF COMBUSTION CHAMBER INSERTS

BACKGROUND OF THE INVENTION

Field of The Invention

The invention relates to a method and an appliance for influencing the wake of combustion chamber inserts, for example fuel nozzle holders, fuel nozzles, rib structures, supports, corners and steps.

Discussion of Background

It is known that various inserts, whose wake involves the danger of an undesirable flame holder, are often arranged in combustion chambers.

Thus fuel injection units, as an example of a component integrated in a gas turbine combustion chamber, are often incorporated in the design by means of a curved supply line exposed to the combustion chamber flow. The fuel nozzle holder, which is located transverse to the main flow, likewise forms a dead water region with recirculating flow - as does the blunt end of the nozzle itself. Under certain conditions,-an unintentional flame holder effect can occur there, i.e. a stable flame burns directly in this wake region because fuel is transported into the dead water region by the flow recirculation from the injection location.

The disadvantage of this prior art consists in the fact that because of the relatively long residence period in the combustion zone, in such a flame the formation of pollutants is usually markedly increased relative to the intended (premixed) combustion downstream of the fuel injection. This effect is undesirable in view of the increasingly strict requirements with respect to pollutant emission figures.

The thermal loading of the component can also increase and therefore make a more complicated cooling arrangement for the component wall necessary.

SUMMARY OF THE INVENTION

Accordingly, one object of the invention is to avoid all these disadvantages and to provide a novel method and appliance which favorably influence the wake at combustion chamber inserts.

In accordance with the invention, this is achieved by a method wherein an additional air mass flow is blown into a combustion chamber, before the actual combustion zone, in the wake of the part of the inserts situated transverse to the main flow and in such a way that the recirculating flow region is minimized. In accordance with the invention, this is achieved in an appliance for carrying out the method by a passage for guiding the additional air mass flow being arranged within the inserts, which passage is connected to outlet openings which are arranged in at least one row in the part of the inserts located opposite to the main flow.

The advantages of the invention may be seen, inter alia, in that the undesirable flame holder effect is reduced and in that, nevertheless, good mixing of the additional air and the main mass flow is achieved before the supply of fuel and before combustion so that the pollutant emissions are reduced. Furthermore, additional thermal loading of the component is prevented.

It is particularly desirable for the additional air mass flow to be extracted from the heated combustion chamber cooling air.

It is also advantageous for the additional air mass flow to be used for possible cooling of the inserts.

In addition, it is advantageous for the outlet openings to be arranged over the complete length of the part of the inserts which is located opposite to the main flow direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
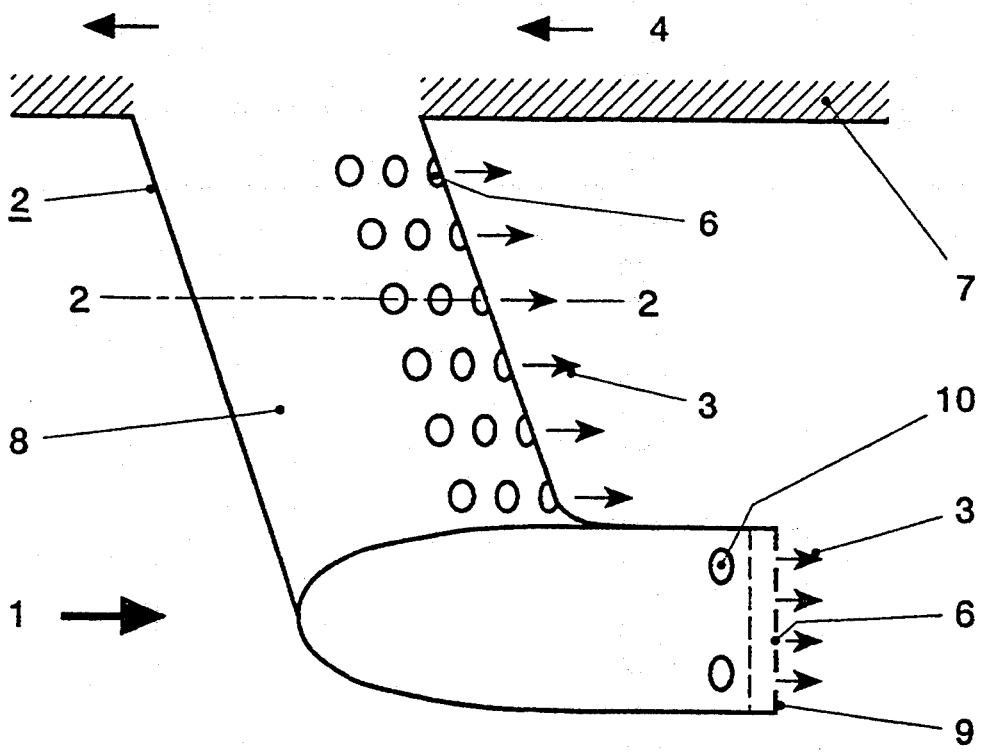
FIG. 1 shows the arrangement of the fuel nozzle holder in the combustion chamber.
Figure 2:
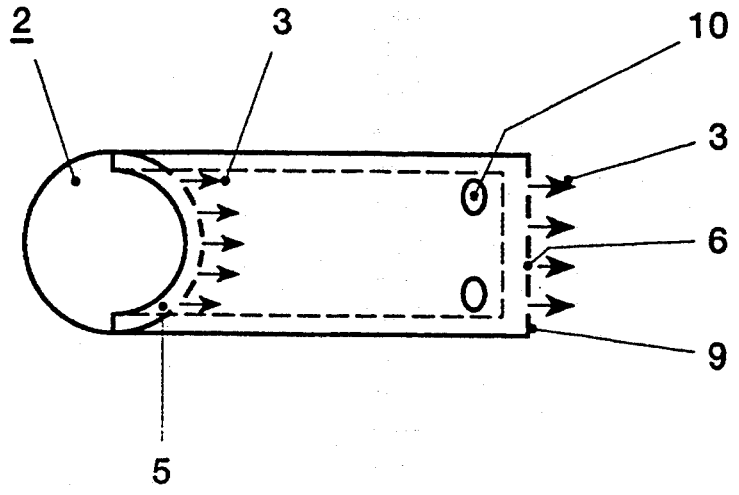
FIG. 2 shows a cross-section through the fuel nozzle holder.

Referring now to the drawings, wherein like reference numerals designate identical or corresponding parts in the two views, in which only the elements essential to understanding the invention are shown and in which the direction of the combustion chamber flow and the flow direction of the additional air is indicated by arrows, inserts 2 in the form of a fuel nozzle holder 8 and a fuel nozzle 9 are arranged on the combustion chamber wall 7 in a gas turbine combustion chamber. The cylindrical fuel nozzle holder 8 is located transverse to the main flow 1 of the combustion chamber. Like the blunt end of the fuel nozzle 9 itself, it forms a region with recirculating flow. These regions are reduced and can also be completely obviated if, as shown in FIG. 1 and FIG. 2, the fuel nozzle holder 8 and the fuel nozzle 9 have a plurality of outlet openings 6 and a passage 5 for an additional air mass flow 3 in their parts located opposite to the main flow 1 and if this additional air mass flow 3 is blown out before the actual combustion zone in such a way that the flow recirculation is minimized.

The admixture of the additional air mass flow 3 through the passage 5 and the outlet opening 6 takes place before the actual combustion zone so that this additional air takes part completely in the combustion and does not lead to an indirect increase in the pollutant Figures.

By this means and depending on the blowing rate, the necessary reduction of the flame holder effect can be achieved, despite good mixing between the additional air mass flow 3 and the main mass flow 1, before the fuel injection 10 and before combustion.

In the present embodiment example, the additional air mass flow 3 is extracted from the heated combustion cooling air 4. The additional air 3 can, of course, also be taken from other airflows.

A further advantage of the invention is provided by the fact that the additional air mass flow 3 can also be used simultaneously for the cooling of the fuel nozzle holder 8 and the fuel nozzle 9 which may be necessary.

The solution according to the invention for reducing the wake recirculation can basically be applied to all combustion chamber inserts 2 whose wake involves the danger of an undesirable flame holder. These can, for example, be rib structures, supports, corners and steps—in addition to the fuel nozzle holders and fuel nozzles already mentioned.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A method for for preventing a flame holder effect in a wake of a fuel nozzle holder and a fuel nozzle attached to an end of the fuel nozzle holder projecting transversely in a main air mass flow in a combustion chamber, comprising the steps of:

guiding an additional air mass flow through a fuel nozzle holder located upstream of a combustion zone of the combustion chamber;

blowing the additional air mass flow out of the fuel nozzle holder into the combustion chamber, upstream of the fuel nozzle anti an actual combustion flame zone and in the wake of the pan of the fuel nozzle holder so that a recirculating flow region is minimized to prevent a flame holder effect.

2. The method as claimed in claim 1, wherein the additional air mass flow is extracted from the heated combustion chamber cooling air.

3. The method as claimed in claim 1, wherein the additional air mass flow is used for cooling the inserts.

4. An apparatus for preventing a flame holder effect in a wake of combustion chamber inserts, comprising:

a combustion chamber having a fuel nozzle holder that projects transversely in a main air mass flow in the combustion chamber, the fuel nozzle holder having a fuel nozzle attached to an end of the fuel nozzle holder and extending downstream of the fuel nozzle holder and upstream of a combustion flame zone; and a passage for guiding an additional air mass flow within the fuel nozzle holder, the passage being connected to a plurality of outlet openi in at least one row in a downstream pan of the fuel nozzle holder opposite to the main flow.

5. The apparatus as claimed in claim 4, wherein the outlet openings are arranged over entire surface of the fuel nozzle holder located opposite to the main flow.

6. The method as claimed in claim 1, wherein the additional air mass is blown into the combustion chamber main flow so that the additional air mass flow mixes completely with the main flow for combustion.

7. The apparatus as claimed in claim 4, wherein the fuel nozzle attached to an end of the fuel nozzle holder is a premixing fuel nozzle.

8. The apparatus as claimed in claim 4, wherein the outlet openings are arranged in both the fuel nozzle holder and the fuel nozzle.

* * * * *